US005260711A

United States Patent [19]

Sterzer

[11] Patent Number: 5,260,711

[45] Date of Patent: Nov. 9, 1993

[54] DIFFERENCE-IN-TIME-OF-ARRIVAL DIRECTION FINDERS AND SIGNAL SORTERS

[75] Inventor: Fred Sterzer, Princeton, N.J.

[73] Assignee: MMTC, Inc., Princeton, N.J.

[21] Appl. No.: 19,665

[22] Filed: Feb. 19, 1993

[51] Int. Cl.[5] ..... H01Q 3/22

[52] U.S. Cl. ..... 342/375

[58] Field of Search ..... 342/375

[56] References Cited

U.S. PATENT DOCUMENTS 4,204,655 5/1980 Gulick et al. ..... 244/3.19
4,656,642 4/1987 Apostolos et al. ..... 342/375
4,888,593 12/1989 Friedman et al. ..... 342/387
5,041,836 8/1991 Paschen et al. ..... 342/375
5,107,273 4/1992 Roberts ..... 342/417

*Primary Examiner*—Theodore M. Blum
*Attorney, Agent, or Firm*—George J. Seligsohn

[57] ABSTRACT

A difference-in-time-of-arrival direction finder includes auto-correlation means that includes means for substantially reducing, at the output of the auto-correlation means, the unwanted noise power of all uncorrelated unselected incoming radio-waves received at two spaced antennas that arrive from any direction other than a certain direction with respect to the wanted signal correlated power of that selected one incoming radio-wave arriving from the certain direction with respect to the line connecting the antennas specified by a given signal time delay provided by a delay line associated with one of the antennas.

19 Claims, 5 Drawing Sheets

PRIOR ART

DIFFERENCE-IN-TIME-OF-ARRIVAL DIRECTION FINDERS AND SIGNAL SORTERS

This invention was made with Government support and the Government has certain rights to this invention.

This application is a substitute application for now-abandoned original application Ser. No. 07/875,012, filed Apr. 28, 1992.

BACKGROUND OF THE INVENTION

1. Field of the Invention

This invention relates to the use of difference-in-time-of-arrival apparatus for direction finders and signal sorters, as well as for reducing the detrimental effects of multipath transmission in television receivers, and, more particularly, to an improved auto-correlator for.-such difference-in-time-of-arrival apparatus.

2. Description of the Prior Art

There are several known types of direction finders that incorporate a radio-wave-signal receiver. Such direction finders are useful in determining the azimuth (and/or elevation) direction of a particular radio-wave-signal transmitter. The most common type of direction finder, which requires that the frequency of the the particular radio-wave-signal transmitter be known, comprises a radio-wave-signal receiver incorporating a fixed phased array or movable directional antenna tuned to the known given frequency. Another known type of direction finder, with which the present invention is concerned, does not require that the frequency of the the particular radio-wave-signal transmitter be known. Instead, this other known type of direction finder, which comprises two similar fixed antennas that are spaced a given fixed distance apart, determines the direction of any of all the radio-wave signals then being received by the two fixed antennas in accordance with the difference in time of arrival of such signals at each of the two fixed antennas. Specifically, when a variable time delay means coupled to one of the two antennas is adjusted to provide a certain time delay equal to the difference in time of arrival of a given signal arriving from a given direction with respect to a line connecting the two antennas, only the delayed given signal received by the one antenna will be correlated with the given signal received by the other antenna. An auto-correlator is used to detect the correlated given signal arriving from the given direction.

However, each of the two antennas is capable of receiving all frequencies within the same broad frequency band defined by the similar structure of each of the two antennas. Therefore, each antenna normally receives radio-wave signal power occurring at many different frequencies within this frequency band and arriving from many different directions. At a time-delay value corresponding to the direction of the given signal, the value of the total power output from the auto-correlator will include (1) a desired correlated.component proportional substantially to all the radio-wave frequency power arriving at the two antennas from the given direction, and (2) an undesired uncorrelated component resulting from some unknown fraction of the sum of the radio-wave frequency power arriving at the two antennas from all other directions from that of the given direction.

The present invention is primarily directed to the structure of an improved auto-correlation means that is capable of maximizing, or at least increasing, the radio between the aforesaid desired correlated-component power and the undesired uncorrelated-component power, which together compose the total power output value thereof, thereby increasing the selectivity and accuracy of a difference-in-time-of-arrival direction finder which incorporates such improved auto-correlation means. In addition to its use as a direction finder, similar difference-in-time-of-arrival equipment is useful as a signal sorter.

SUMMARY OF THE INVENTION

The present invention is primarily directed to improved auto-correlation means for a system responsive to the difference-in-time-of-arrival of received radio-wave signals for finding the direction of any one radio-wave signal and/or sorting the received radio-wave signals from one another; wherein the system comprises first and second antennas spaced apart by a predetermined distance for receiving radio-wave signals within a given frequency band, variable time delay means for time delaying the radio-wave signals received by one of the first and second antennas with respect to the radio-wave signals received by the other of the first and second antennas by an amount determined by the time delay means, and auto-correlation means responsive to the correlation between the delayed radio-wave signals received by the one of said first and second antennas and the radio-wave signals received by the other of said first and second antennas.

The improved auto-correlation means comprises first and second means. The first means is responsive to the relative phases of the relatively delayed radio-wave signals received by the first and second antennas for deriving a given output therefrom in which solely in-phase relatively delayed radio-wave signals received respectively by the first and second antennas are substantially cancelled and out-of-phase relatively delayed radio-wave signals received respectively by the first and second antennas are substantially passed. The second means includes variable gain and delay means and is responsive to the output of said first means applied thereto for reducing the relative power of the out-of-phase relatively relatively delayed radio-wave signals with respect to that of the in-phase relatively delayed radio-wave signals in an output of the auto-correlation means.

DESCRIPTION OF THE PREFERRED EMBODIMENTS

Figure 1:
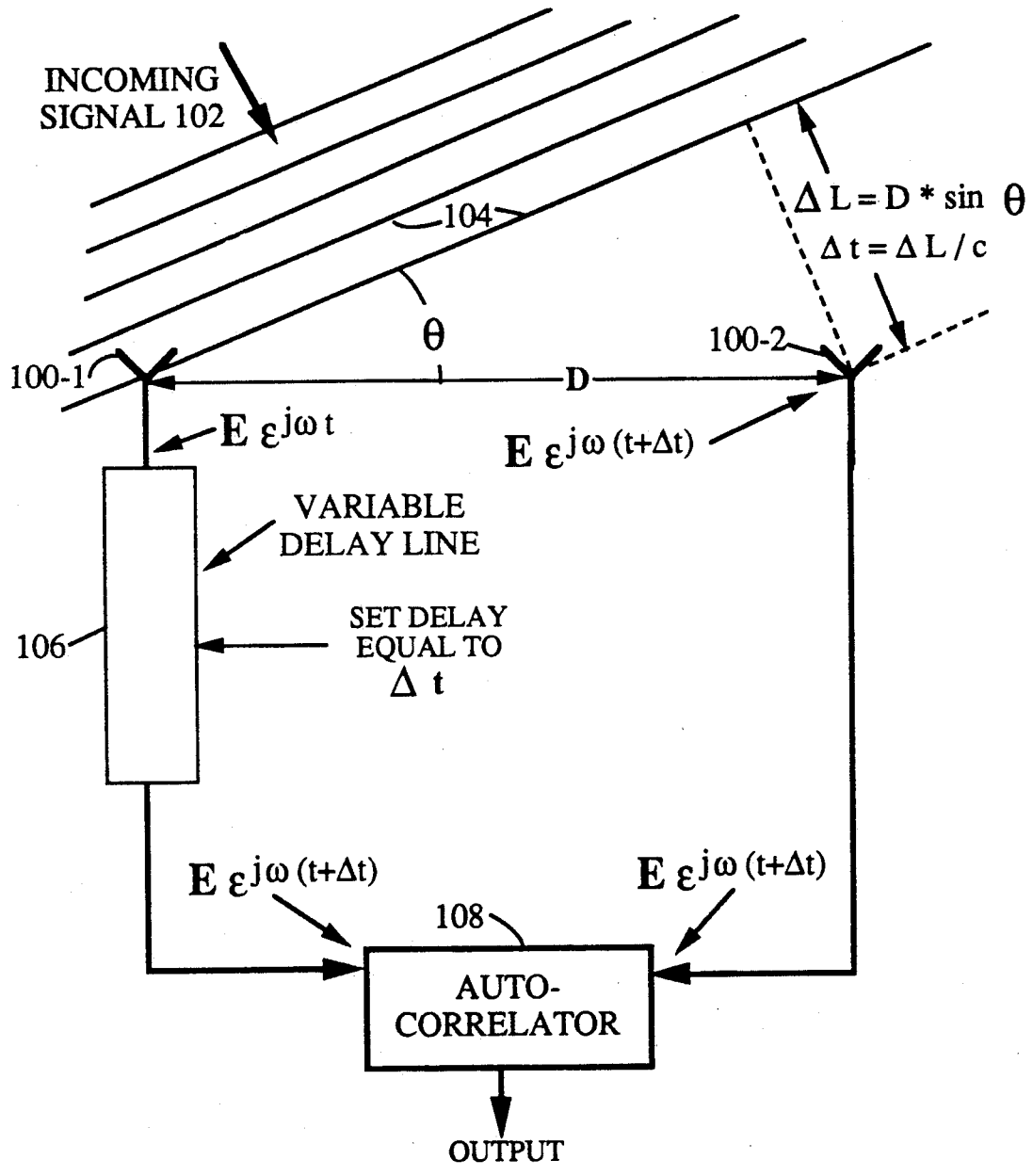
FIG. 1 is a functional diagram of the overall system of a difference-in-time-of-arrival direction finder, as known in the prior art.

Referring to FIG. 1, the known system of a difference-in-time-of-arrival direction finder comprises two antennas 100-1 and 100-2 spaced from one another by a known fixed distance D. An incoming radio-wave signal 102 (indicated by respective plane radio-wavefronts 104), arriving from the upper-left of the drawing, is inclined at an angle $\theta$ with respect to distance D. Therefore, as indicated in FIG. 1, when a leading radio-wavefront 104 reaches antenna 100-1, this leading radio-wavefront 104 will be spaced a distance $\Delta L = D * \sin\theta$ from antenna 100-2. Since the radio-wave signal 102 reaching the two antennas from a remote transmitter travels substantially at the speed of light c, the leading radio-wavefront 104 will reach antenna 100-2 at a time delay $\Delta t = \Delta L/c$ after it reaches antenna 100-1. Thus, if the incoming radio-wave signal 102 induces a voltage $E\epsilon^{j\omega t}$ in antenna 100-1, it will induce a time-displaced voltage $E\epsilon^{j\omega(t+\Delta t)}$ in antenna 100-2, which is uncorrelated with the induced voltage $E\epsilon^{j\omega t}$ in antenna 100-1.

However, (as is also indicated in FIG. 1) by passing the induced voltage $E\epsilon^{j\omega t}$ from antenna 100-1 through variable delay line 106 and setting the delay of variable delay line 106 equal to $\Delta t$, the voltage output $E\epsilon^{j\omega(t+\Delta t)}$ from variable delay line 106 now will become and remain correlated with the voltage $E\epsilon^{j\omega(t+\Delta t)}$ from antenna 100-2 (i.e., they will remain continuously in phase with one another). However, with the delay of variable delay line 106 set equal to $\Delta t$, an incoming radio-wave signal inclined at any angle other than $\theta$ with respect to distance D results in the voltage output from variable delay line 106 being substantially uncorrelated (out of phase) with the voltage from antenna 100-2.

In practice, variable delay line 106 may comprise (1) a coarse variable delay line for dividing a given maximum time interval range into a plurality of coarse sub-intervals, in series with (2) a fine variable delay line for dividing a single coarse sub-interval into a plurality of fine sub-intervals. In this manner, the value of $\Delta t$ may be efficiently selected with a high degree of precision over a large time interval range. For illustrative purposes, it has been assumed that incoming signal 102 is arriving from the upper-left of the drawing and, therefore, the variable delay line is shown in FIG. 1 is associated with antenna 100-1. For the case in which the incoming signal is arriving from the upper-right of the drawing, the variable delay line would be associated with antenna 100-2. In practice an individual variable delay line, which is capable of being set to a zero time delay or, alternatively, of being bypassed, may be associated with each of antennas 100-1 and 100-2.

In any event, the respective voltages from antennas 100-1 and 100-2, after being relatively delayed with respect to one another by $\Delta t$, are applied as inputs to auto-correlator 108. Auto-correlator 108 is a device for deriving a power output that ideally is solely responsive to the correlated portion of the voltage inputs thereto. However, in practice, the output power from auto-correlator 108 comprises both a major desired power component due to incoming radio-wave signal 102 inclined at an angle $\theta$ with respect to distance D and a minor undesired (noise) power component due to all other incoming radio-wave signals arriving at antennas 100-1 and 100-2 which are inclined at angles other than $\theta$ with respect to distance D.

Figure 2:
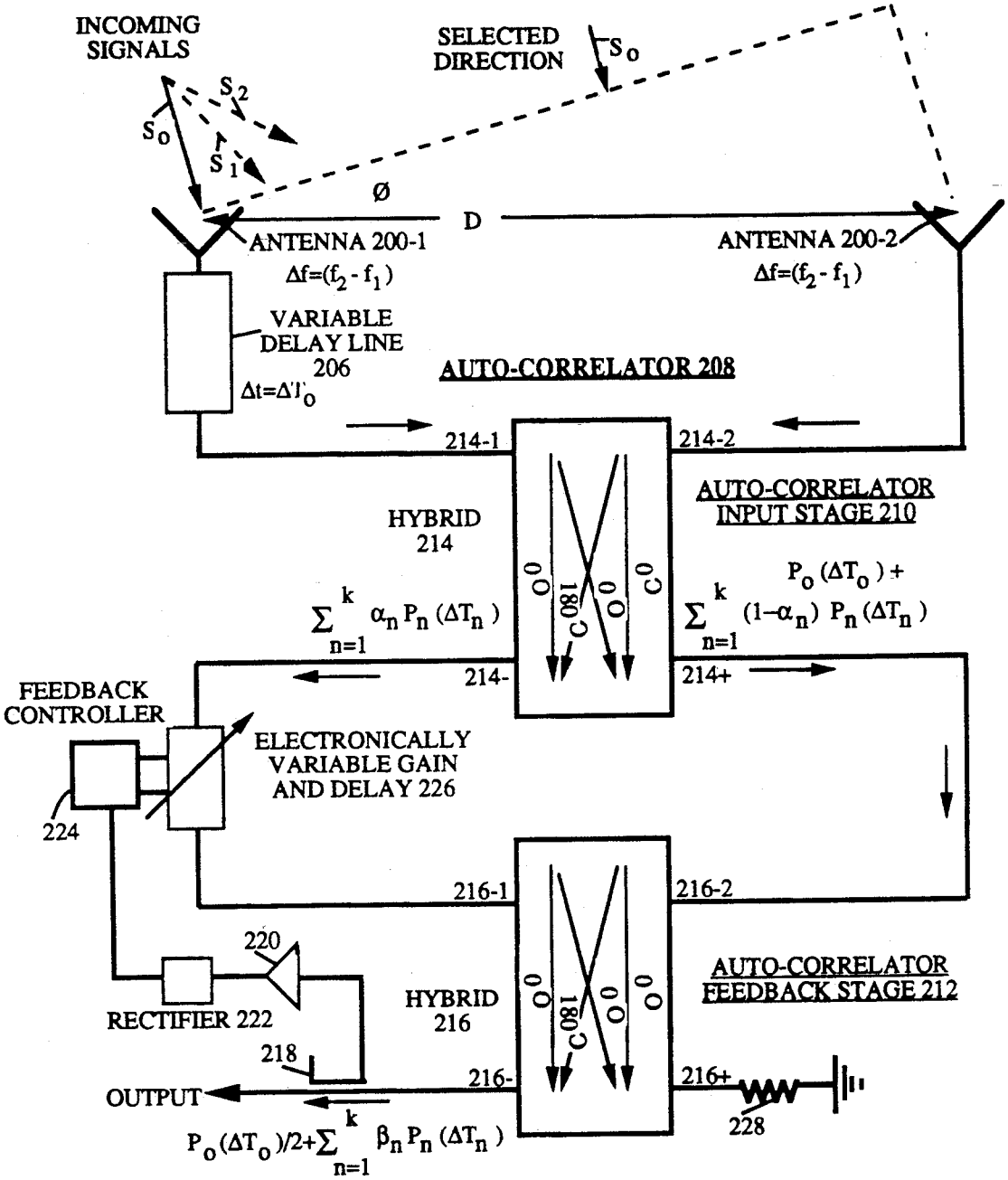
FIG. 2 is a functional diagram of a difference-in-time-of-arrival direction finder system including a first embodiment of an improved auto-correlator of the present invention that employs a single feedback stage.
Figure 2A:
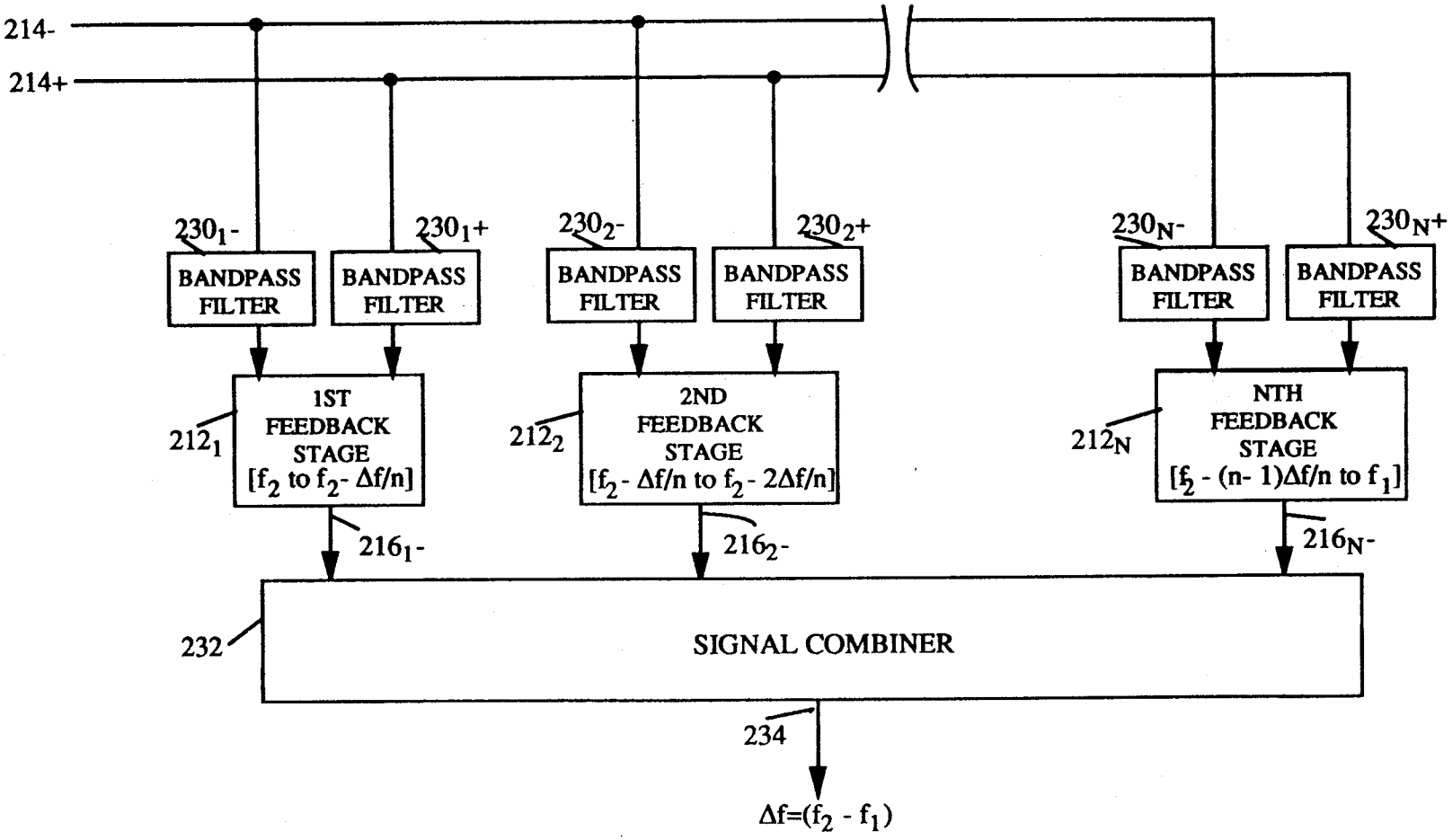
FIG. 2*a* is a functional diagram of a modification of the improved auto-correlator of FIG. 2 that employs a plurality of feedback stages, which modification constitutes a second embodiment of the present invention.
Figure 3:
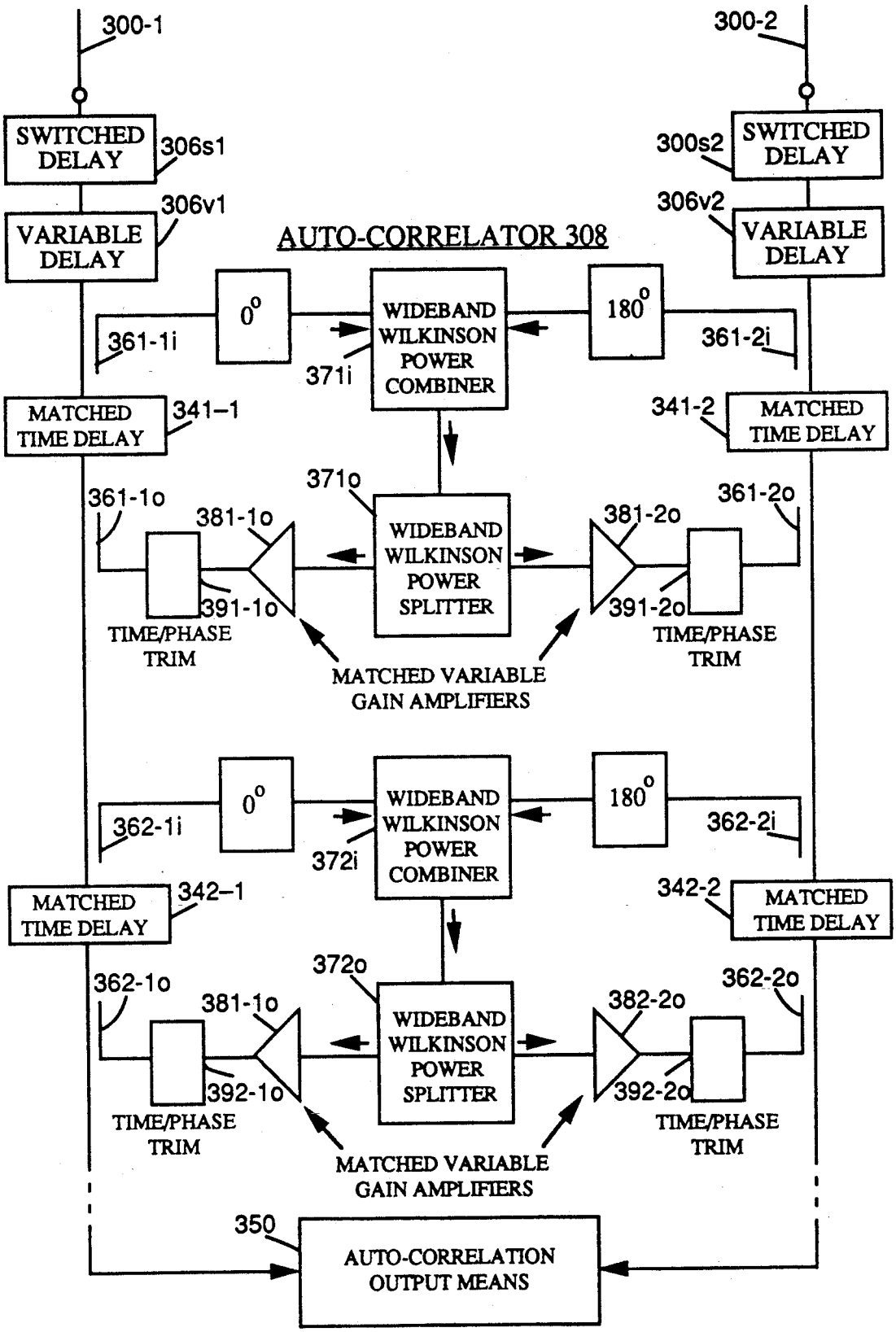
FIG. 3 is a functional diagram of a difference-in-time-of-arrival direction finder system including a second embodiment of an improved auto-correlator of the present invention.

The present invention is directed to the relatively simple structure of a first improved auto-correlator (embodiments of which are shown in FIGS. 2 and 2a) and a second improved auto-correlator (an embodiment of which is shown in FIG. 3) which are effective in maximizing, or at least increasing, the ratio of the aforesaid desired component power to the undesired component power in the total power output of the improved auto-correlator.

In FIG. 2, antenna 200-1, antenna 200-2 and variable delay line 206, respectively, correspond in structure and function with antenna 100-1, antenna 100-2 and variable delay line 106 of FIG. 1. Each of antennas 200-1 and 200-2 is capable of receiving all incoming radio-wave signals (such as $S_0$, $S_1$ and $S_2$) within a broad frequency band $\Delta f = (f_2 - f_1)$.

The improved auto-correlator, shown in FIG. 2, comprises auto-correlator input stage 210 followed by a single auto-correlator feedback stage 212. Auto-correlator input stage 210 comprises hybrid means 214 having first and second input ports 214-1 and 214-2 and first and second output ports 214− and 214+. Auto-correlator feedback stage 212 comprises hybrid means 216 having first and second input ports 216-1 and 216-2 and first and second output ports 216− and 216+. Auto-correlator feedback stage 212 further comprises directional coupler 218, amplifier 220, rectifier 222, feedback controller 224, electronically variable gain and delay means 226, and load resistance 228.

The output from variable delay line 206 is applied to first input port 214-1 and the output from antenna 200-2 is applied to second input port 214-2 of hybrid means 214 of input stage 210. The output from difference output port 214− of hybrid means 214 of input stage 210 is applied to first input port 216-1 of hybrid means 216 of feedback stage 212 through electronically variable gain and delay means 226 of feedback stage 212 and the output from sum output port 214+ of hybrid means 214 of input stage 210 is applied directly to second input port 216-2 of hybrid means 216 of feedback stage 212. Directional coupler 218 samples the output power appearing at output port 216− of hybrid means 216 of feedback stage 212, and the value of the power from these samples, after being amplified and then rectified by amplifier 220 and rectifier 222, is applied as a control input to feedback controller 224. The output from feedback controller 224 is used to set the gain and delay inserted by electronically variable gain and delay means 226. Load resistance 228, which is coupled between output port 216+ of hybrid means 216 of feedback stage 212 and a point of reference potential, dissipates the output power appearing at output port 216+.

As known in the art, a hybrid means derives an output at its minus output port that is proportional to the difference between the respective signals applied to its two input ports and derives an output at its plus output port that is proportional to the sum of the respective signals applied to its two input ports. Assume for a moment that incoming signal $S_0$ is the only radio-wave signal being received by antennas 200-1 and 200-2, and that the delay $\Delta t$ provided by variable delay line 206 has been set equal to $\Delta T_0$, so that the selected direction is that of incoming signal $S_0$ (as indicated in FIG. 2). In this case, the output from variable delay line 206 will be and continuously remain correlated with the output from antenna 200-2. Therefore, based on the aforesaid assumption, the power of these two outputs, which are respectively applied to input ports 214-1 and 214-2 of hybrid means 214 of input stage 210, will cancel one another to provide zero power at difference output port 214− thereof, but add to one another to provide a power equal to $P_0(\Delta T_0)$ at sum output port 214+ thereof.

However, the aforesaid assumption does not usually conform to reality. Often antennas 200-1 and 200-2 are receiving incoming radio-wave signals from other directions, such as incoming signals $S_1$ and $S_2$, in addition to selected incoming signal $S_0$. With the delay of variable delay line 206 set to $\Delta T_0$, the output thereof will include a component due to such other-direction incoming signals as $S_1$ and $S_2$ which is uncorrelated with that of the output from antenna 200-2, Further, the respective frequencies of $S_1$ and $S_2$ will normally be different from that of $S_0$ and one another. The result is that the power of the uncorrelated component due to $S_1$ and $S_2$, applied along with $S_0$ to the two inputs of input hybrid means 214, will not cancel at difference output port 214− thereof. In general quantitative terms, if the uncorrelated component comprises n separate incoming signals arriving from other directions from that of the selected incoming signal $S_0$ and $\alpha$ is some first unknown fraction having a value between zero and one for each of the n incoming radio-wave signals other than the selected incoming signal $S_0$, the power output at difference output port 214− is $$\sum_{n=1}^{k} \alpha_n P_n(\Delta T_n)$$

and at sum output port 214+ is $$P_0(\Delta T_0) + \sum_{n=1}^{k} (1 - \alpha_n) P_n(\Delta T_n).$$

In other words, the total power of the uncorrelated component is divided between output ports 214− and 214+ in an unknown manner, with all of the power at difference output port 214+ consisting of some fractional portion of the uncorrelated-component power and the power at sum output port 214+ consisting of all of the correlated-component power plus the remainder portion of the uncorrelated-component power. The problem is to find a way to reduce the total power of the undesired uncorrelated component to a greater extent than any accompanying reduction in the the total power of the desired correlated component, thereby increasing the ratio of desired correlated-component power to undesired uncorrelated-component power. Feedback state 212 solves this problem.

Specifically, as indicated in FIG. 2, input port 216-1 of hybrid 216 of feedback stage 212 receives as an input thereto solely the fractional portion of the uncorrelated-component power appearing at difference output port 214− of hybrid 214 of input stage 210, after this fractional portion has undergone a certain gain and delay provided by means 226. However, input port 216-2 of hybrid 216 of feedback stage 212 receives as an input thereto all of the correlated-component power $P_0(\Delta T_0)$ plus the remainder portion of the uncorrelated-component power appearing at sum sum output port 214+ of hybrid 214 of input stage 210. Thus, one half of the correlated-component power, $P_0(\Delta T_0)/2$, appears at the difference output port 216− of hybrid 216 and the other half appears at the sum output port 216+ of hybrid 216. However, the relative amplitude and phase of the respective uncorrelated-component power applied to each of the input ports 216-1 and 216-2 controls how the uncorrelated-component power is divided between the difference output port 216− and the sum output port 216+ of hybrid 216. All of both the correlated and uncorrelated-component power appearing at sum output port 216+ is dissipated in load resistance 228. This leaves $$P_0(\Delta T_0)/2 + \sum_{n=1}^{k} \beta_n P_n(\Delta T_n),$$

the total power appearing at difference output port 216−, as the output of feedback stage 212 (where.$\beta$ is some second unknown fraction having a value between zero and one for each of the n incoming radio-wave signals other than the selected incoming signal $S_0$).

Feedback is employed by stage 212 to minimize the fraction of the uncorrelated portion $$\sum_{n=1}^{k} \beta_n P_n(\Delta T_n)$$

of the power output therefrom at port 216− (thereby maximizing the remainder of the uncorrelated portion power $$\sum_{n=1}^{k} (1 - \beta_n) P_n(\Delta T_n)$$

at port 216+, which is dissipated in load resistance 228). Specifically, feedback controller 224 includes means, such as a microprocessor and associated memory, capable of sequencing means 226 through a two-dimensional matrix of different predetermined combinations of gain and delay values. The value of the fraction of the uncorrelated portion $$\sum_{n=1}^{k} \beta_n P_n(\Delta T_n)$$

in the feedback stage output depends on the then current combination of gain and delay values provided by means 226. However, the value of the correlated portion $P_0(\Delta T_0)/2$ of the power output of stage 212 at port 216− is independent of gain and delay values provided by means 226. Directional coupler 218 samples the output power value at port 216−, and after amplification by amplifier 220 and rectification by rectifier 222, stores this value in feedback controller 224 in association with the then current predetermined combination of gains and delay values. After feedback controller 224 has sequenced means 226 through the entire two-dimensional matrix of different predetermined combinations of gains and delay values, a single certain one of the output values now stored in feedback controller 224 will be smallest in value. Feedback controller 224 now controls the gain and delay values provided by means 226 with that matrix predetermined combination associated with this stored smallest difference output value, thereby reducing the undesired uncorrelated portion of the output power of feedback stage 212 to a minimum value.

In those cases in which antennas 200-1 and 200-2 receive only the radio waves from a single incoming signal arriving from another direction from that of the selected incoming signal incoming signal $S_O$, the minimum value of the undesired uncorrelated portion of the output power of feedback stage 212 can be made relatively very small. However, in those cases in which antennas 200-1 and 200-2 receive the radio waves from a plurality of incoming signals arriving from other directions from that of the selected incoming signal incoming signal $S_O$, the minimum value of the undesired uncorrelated portion of the output power of feedback stage 212 is limited by the fact that each of these plurality of incoming signals cannot individually be reduced to a minimum value simultaneously, so that the best achievable minimum value of the undesired uncorrelated portion obtainable by the FIG. 2 embodiment of the present invention is a compromise that is larger than would be the minimum value of each of these plurality of incoming signals individually. The modification of the FIG. 2 embodiment shown in the embodiment of FIGS. 2*a* greatly reduces this aforesaid limitation of the FIG. 2 embodiment, thereby making it possible to achieve a significantly smaller minimum value of the undesired uncorrelated portion of the output power of feedback stage 212 than the FIG. 2 embodiment.is capable of achieving.

In the FIG. 2*a* embodiment, the broad frequency band $\Delta f=(f_2-f_1)$ of antennas 200-1 and 200-2 is divided into N contiguous narrower frequency bands. For illustrative purposes, it is assumed in FIG. 2*a* that each of these N narrower frequency bands has the same bandwidth $\Delta f/n$ (where $n=N$, so that all of the these narrower frequency bands have equal bandwidths). However, this assumed relationship among the bandwidths of the these N contiguous narrower frequency bands is not essential. The N contiguous narrower frequency bands may have different bandwidths from one another.

Specifically, as shown in the FIG. 2*a* modification of FIG. 2, a plurality of separate feedback stages $\mathbf{212}_1$ to $\mathbf{212}_N$ replaces the single feedback stage 212 of FIG. 2. The internal structure of each of these separate feedback stages $\mathbf{212}_1$ to $\mathbf{212}_N$ is identical to that of single feedback stage 212 of FIG. 2. However, difference output 214− of hybrid 214 of input stage 210 of FIG. 2 is applied respectively as a first input to the hybrid 216 of each of 1st, 2nd, . . . and Nth feedback stages $\mathbf{212}_1$, $\mathbf{212}_2$, . . . and $\mathbf{212}_N$ through respective bandpass filters $\mathbf{230}_1-$, $\mathbf{230}_2-$, . . . and $\mathbf{230}_N-$. In a similar manner, sum output 214+ of input hybrid 214 of input stage 210 of FIG. 2 is applied respectively as a second input to the hybrid 216 of each of 1st, 2nd, . . . and Nth feedback stages $\mathbf{212}_1$, $\mathbf{212}_2$, . . . and $\mathbf{212}_N$ through respective bandpass filters $\mathbf{230}_1+$, $\mathbf{230}_2+$, . . . and $\mathbf{230}_N+$.

The passband of each of bandpass filters $\mathbf{230}_1$- and $\mathbf{230}_1+$ extends from $f_2$ ($f_2$ being the highest frequency in the broad frequency bandwidth of antennas 200-1 and 200-2) to $f_2-\Delta f/n$; the passband of each of bandpass filters $\mathbf{230}_2-$ and $\mathbf{230}_2+$ extends from $f_2-\Delta f/n$ to $f_2-4$ bf/n, and the passband of each of bandpass filters $\mathbf{230}_N-$ and $\mathbf{230}_N+$ extends from $f_2-(n-1)\Delta f/n$ to $f_1$ ($f_1$ being the lowest frequency in the broad frequency bandwidth of antennas 200-1 and 200-2). Therefore, as indicated in FIG. 2*a*, 1st feedback stage $\mathbf{212}_1$ operates solely on incoming signal frequencies within the highest narrow frequency band $f_2$ to $f_2-\Delta f/n$; 2nd feedback stage $\mathbf{212}_2$ operates solely on incoming signal frequencies within the contiguous next-to-highest narrow frequency band $f_2-\Delta f/n$ to $f_2-4$ bf/n; . . . ,and Nth feedback stage $\mathbf{212}_N$ operates solely on incoming signal frequencies within the contiguous lowest narrow frequency band $f_2-(n-1)\Delta f/n$ to $f_1$. The difference outputs $\mathbf{216}_1-$, $\mathbf{216}_2-$ and $\mathbf{216}_N-$ of the respective hybrids 216 of of 1st, 2nd, . . . and Nth feedback stages $\mathbf{212}_1$, $\mathbf{212}_2$, . . . and $\mathbf{212}_N$ are applied as inputs to signal combiner 232, which derives output 234 therefrom having the original broad bandwidth, $\Delta f=f_2-f_1$ of antennas 200-1 and 200-2.

It is apparent that the total correlated and uncorrelated power of all incoming radio-wave signals within the broad frequency bandwidth of antennas 200-1 and 200-2 is apportioned among the plurality of feedback stages $\mathbf{212}_1$, $\mathbf{212}_2$, . . . and $\mathbf{212}_N$ in accordance with the frequency distribution thereof. By independently operating feedback controller 224 of each separate one of feedback stages $\mathbf{212}_1$, $\mathbf{212}_2$, . . . and $\mathbf{212}_N$ in the manner described above to provide its means 226 with that matrix predetermined combination associated with the stored smallest value of the difference output of that separate feedback stage, the undesired uncorrelated portion of the output power of that separate feedback stage is reduced to its minimum value. Such independent operation of the feedback controller 224 of each separate one of feedback stages $\mathbf{212}_1$, $\mathbf{212}_2$, . . . and $\mathbf{212}_N$ results in the minimum achievable value of the total undesired uncorrelated portion of the power in all of the respective outputs $\mathbf{216}_1-$, $\mathbf{216}_2-$, . . . and $\mathbf{216}_N-$ of the plurality of feedback stages $\mathbf{212}_1$, $\mathbf{212}_2$, . . . and $\mathbf{212}_N$ (which are combined in signal combiner 232 to form single output 234) to be significantly smaller than the minimum achievable value of the undesired uncorrelated portion of the difference output power 216 from the single feedback stage 212 of FIG. 2.

There may be other ways from that shown in the FIG. 2*a* embodiment for minimumizing the achievable value of the undesired uncorrelated portion of the difference output power at the difference output of the last feedback stage. For instance, it is believed that either a plurality of cascaded feedback stages or a plurality of cascaded complete FIG. 2 embodiments could be employed for this purpose.

As discussed above, antennas 200-1 and 200-2 receive radiowave signals within the broad frequency band between $f_1$ and $f_2$. If this broad frequency band is in the microwave region (e.g., 1 GHz band), a given difference-in-time-of-arrival of two radio-wave signals represents a much greater phase difference $\phi$ than if this broad frequency band is in the mid-radio-frequency region (e.g., 10 MHz band), since $\phi=f(\Delta t)$. Thus, autocorrelator 208 is capable of providing significantly greater directional selectivity in discriminating between the correlated and uncorrelated radio-wave power of two incoming microwave radio-wave signals arriving from only slightly different given directions than in discriminating between the correlated and uncorrelated radio-wave power of two incoming mid-radio-frequency signals arriving from these slightly different given directions.

Reference is now made to an illustrative example of a difference-in-time-of-arrival apparatus that employs the second improved auto-correlator embodiment shown in FIG. 3 for providing a high degree of directional selectivity in discriminating between correlated and uncorrelated radio-wave power of incoming radio-wave signals arriving from different given directions.

As shown in FIG. 3, two wideband omnidirectional antennas 300-1 and 300-2 that are spaced from one another by a given distance (e.g., one meter, for instance). It is assumed that each of omnidirectional antennas 300-1 and 300-2 is simultaneously receiving a plurality of separate radio-wave signals (which may have different frequencies within the wideband) arriving from different directions. The outputs of antennas 300-1 and 300-2 are respectively forwarded through a first delay line comprising switched delay 306s1 and variable delay 306v1 to a first input of auto-correlator 308 and through a second delay line comprising switched delay 306s2 and variable delay 306v2 to a second input of auto-correlator 308. Each of switched delays 306s1 and 306s2 permits the delay inserted thereby to be switched between zero and a maximum in a plurality of discrete incremental amounts. Each of variable delays 306v1 and 306v2 is capable of inserting a continuously variable delay of between zero and a single incremental amount. Thus, the delay inserted by the first delay line and/or the second delay line can be adjusted so that the time of arrival, at the first and second inputs of auto-correlator 308, of only a specified one of the plurality of separate incoming radio-wave signals (directed at a given angle with respect to the line connecting antennas 300-1 and 300-2) is the same as one another (i.e. are correlated in that they have substantially the same amplitude and phase, and constitute wanted signal power). The time of arrival, at the first and second inputs of auto-correlator 308, of each other one of the plurality of separate incoming radio-wave signals (directed at other than the given angle with respect to the line connecting antennas 300-1 and 300-2) are different from one another (i.e. are uncorrelated in that they have different amplitudes and phase, and constitute unwanted noise power). Further, the greater the difference in angular direction in time of arrival at the first and second inputs of auto-correlator 308 (and, hence, the greater the difference in their amplitude and phase) between the angular direction of another one of the plurality of separate incoming radio-wave signals and the given angle of the specified one of the plurality of separate incoming radio-wave signals, the larger will be its contribution to the total unwanted noise power. Auto-correlator 308, described below, is designed to cancel (or, at least, minimize) this total unwanted uncorrelated noise power, starting with the largest contributor to the total unwanted uncorrelated noise power.

Specifically, the output from variable delay 306v1 is applied to the input of matched time delay 340-1, which introduces a predetermined value of time delay between its output and input, and the output from variable delay 306v1 is applied to the input of matched time delay 340-1, which introduces a predetermined value of time delay between its output and input, and the output from variable delay 306v2 is applied to the input of matched time delay 340-2, which introduces the same predetermined value of time delay between its output and input. Therefore, the wanted correlated signal power at the inputs to matched time delays 341-1 and 341-2 remains correlated at their outputs. The outputs from matched time delays 341-1 and 341-2 may be forwarded sequentially through one or more additional pairs of matched time delays (e.g., matched time delays 342-1 and 342-2) before being applied to the inputs of auto-correlation means 350, so that the wanted correlated signal power remains correlated at the inputs to auto-correlation means 350.

A given portion of the total radio-wave power at the output from variable delay 306v1 (that is applied to the input of matched time delay 340-1) is tapped off by coupler 361-1i and applied at 0° (i.e., without being inverted) as a first input to wideband Wilkinson power combiner **371*i*, as functionally indicated in FIG. 3. Similarly, substantially the same given portion of the total radio-wave power at the output from variable delay 306v2 (that is applied to the input of matched time delay 340-2) is tapped off by coupler 361-2i and applied at 180° (i.e., after being inverted) as a second input to wideband Wilkinson power combiner 371*i***, as functionally indicated in FIG. 3.

Since the wanted correlated signal components of the total radio-wave power at the first and second inputs of wideband Wilkinson power combiner **371*i* are 180° out-of-phase with one another, the radio-wave power of this wanted correlated signal component will be substantially cancelled at the output of Wilkinson power combiner 371*i*. Thus, all the the radio-wave power at the output of Wilkinson power combiner 371*i* constitutes only unwanted uncorrelated noise power. This unwanted uncorrelated noise power is forwarded to the input of Wilkinson power splitter 371o. Wilkinson power splitter 371*o* derives first and second outputs therefrom which are respectively forwarded to coupler 361-1o through matched variable gain amplifier 381-1o and time/phase 391-1o, and to coupler 361-2o through matched variable gain amplifier 381-2o and time/phase 391-2o. Coupler 361-1o is effective in combining the unwanted uncorrelated noise power thereat with the total radio-wave power at the output from matched time delay 341-1 and coupler 361-2o is effective in combining the unwanted uncorrelated noise power thereat with the total radio-wave power at the output from matched time delay 341-2**.

Adjustment of (1) matched variable gain amplifiers 381-1 and 381-2 and (2) each of time/phase 391-1o and 391-2o to the point at which the combined total radio-wave power beyond matched time delay 341-1 and the combined total radio-wave power beyond matched time delay 341-2 are minimized, results in substantially cancelling the unwanted uncorrelated noise power contribution of that one of the incoming radio waves which is the largest contributor to the total unwanted uncorrelated noise power (i.e., at this point the noise amplitude and phase of the largest unwanted uncorrelated contributor from each of couplers 361-1o and 361-2o is adjusted to be substantially equal and opposite to that from the output of each of matched time delays 340-1 and 340-2).

A similar group of elements 362-1i, 362-2i, **372*i*, 372*o*, 382-1o, 382-2o, 392-1o, 392-2o, 362-1o, and 362-2o cooperate with the respective inputs to and outputs from matched time delays 340-1 and 340-2 to substantially cancel the unwanted uncorrelated noise power contribution of that one of the incoming radio waves which is the next-to-largest contributor to the total unwanted uncorrelated noise power. Each successively lower noise-power contributor may be substantially cancelled, in turn, in a similar manner, so that the total radio-wave power actually reaching auto-correlation means 350** includes substantially all of the wanted correlated signal power but only a residual amount of the unwanted uncorrelated noise power.

Although auto-correlation means 350 may comprise a conventional auto-correlator known in the art, it preferably includes the above-described embodiment of the present invention shown in FIG. 2 or, alternatively, in FIG. 2*a* for further reducing the residual unwanted uncorrelated noise power reaching the first and second inputs to auto-correlation means 350.

Further, the respective functions performed in FIG. 3 by Wilkinson power combiner 371*i* could instead be performed by hybrid means. In this case, the difference output of a hybrid means corresponds with the output of Wilkinson power combiner 371*i* (with the sum output power of the hybrid means being dissipated in a resistance). Many type of means, including hybrid means, could be used to perform the power splitting function of Wilkinson power splitter 371*o*. However, a Wilkinson power combiner and a Wilkinson power splitter is to be preferred to perform these functions in a difference-in-time-of-arrival apparatus because of their wideband characteristics.

Figure 4:
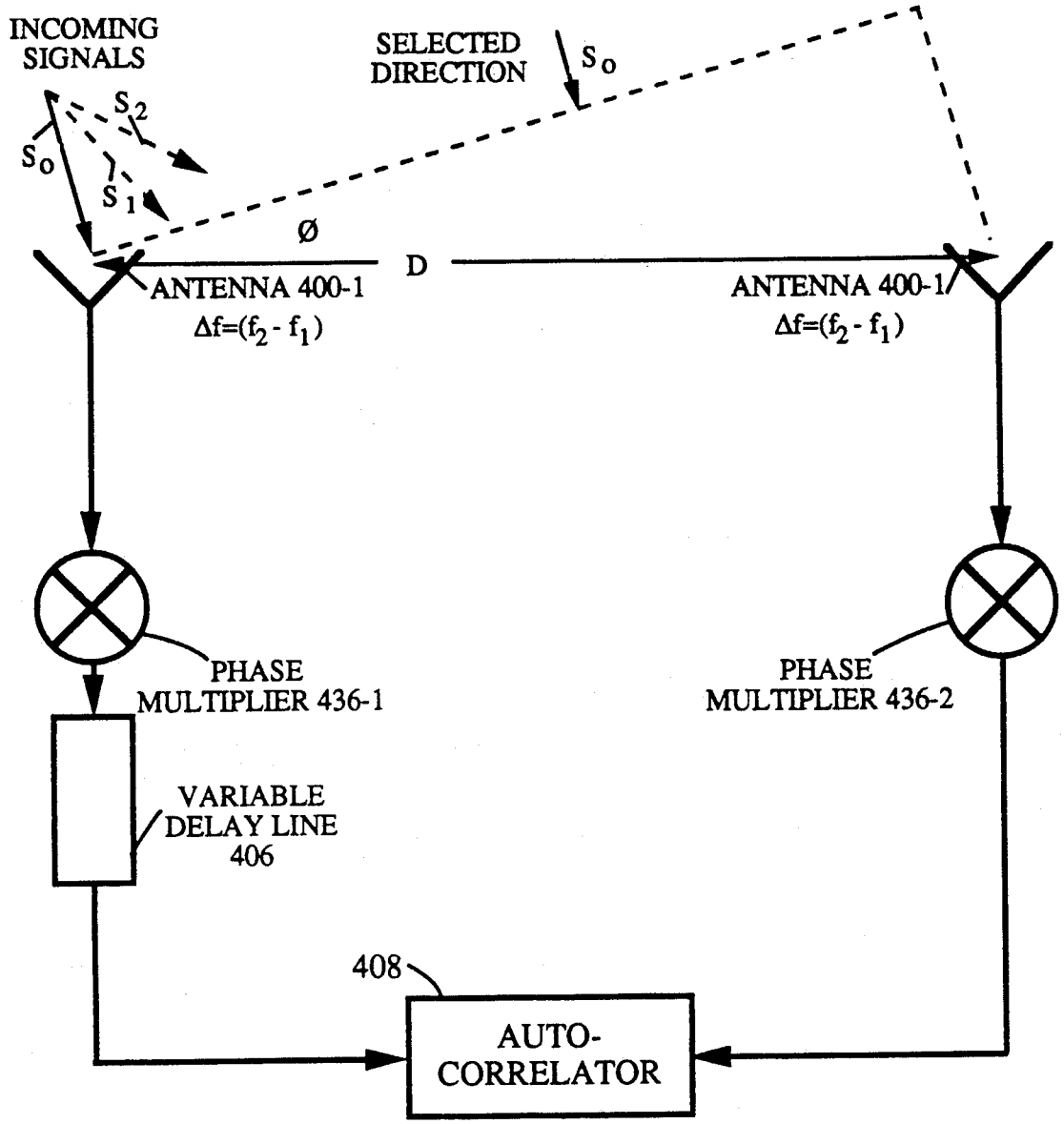
FIG. 4 is a functional diagram of an embodiment of the present invention which employs phase multiplication to improve the selectivity of a difference-in-time-of-arrival direction finder system that is responsive to relatively low-frequency incoming radio-wave signals, and preferably incorporates either the improved auto-correlator of FIG. 2a, FIG. 4 or FIG. 3.

The embodiment of FIG. 4 may be employed to increase the directional selectivity of a difference-in-time-of-arrival direction finder by providing means for multiplying the respective phase values of the radio-wave signals received by first and second antennas 400-1 and 400-2. In this regard, it can be shown by trigonometric analysis that while either up-converting or down-converting an input frequency does not change its phase value at the up-converted or down-converted output frequency, the phase of a given harmonic of an input frequency is multiplied accordingly. Thus, as shown in FIG. 4, the radio-wave signals received by the first antenna 400-1 are passed through phase multiplier 436-1 before being forwarded through variable delay line 406 as a first input to auto-correlator 408, and the radio-wave signals received by antenna 400-2 are passed through phase multiplier 436-2 before being directly forwarded as a second input to auto-correlator 408.

Figure 4A:
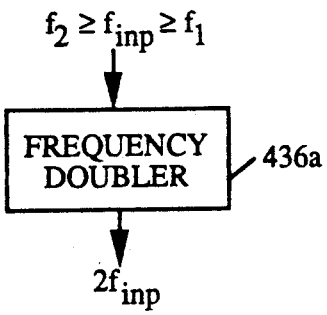
FIGS. 4a and 4b are functional diagrams of two different examples of means for implementing the phase multiplication of FIG. 4.

FIG. 4*a* shows a first example of the implementation of each of each of phase multipliers 436-1 and 436-2. As shown in FIG. 4*a*, each of phase multipliers 436-1 and 436-2 comprises frequency doubler 436*a*, which may take the form of a square-wave amplifier having its output passed through a filter tuned to the second harmonic of the input frequency $f_2 \geqq f_{inp} \geqq f_1$ to frequency doubler 436*a*. Thus, the output frequency from frequency doubler 436*a* is $2f_{inp}$. If the value of the relative difference in phase $\phi = f(\Delta t)$ between the input frequency $f_{inp}$ to the frequency doubler 436*a* of phase multiplier 436-1 and the input frequency $f_{inp}$ to the frequency doubler 436*a* of phase multiplier 436-2, the value of the relative difference in phase between the output frequency $2f_{inp}$ from the frequency doubler 436*a* of phase multiplier 436-1 and the output frequency $2f_{inp}$ from the frequency doubler 436*a* of phase multiplier 436-2 is $2\phi$. Therefore, the directional selectivity in discriminating between the correlated and uncorrelated radio-wave power of two incoming radio-wave signals arriving from only slightly different given directions of the FIG. 4 embodiment, with the FIG. 4*a* implementation of each of phase multipliers 436-1 and 436-2, is doubled.

Figure 4B:
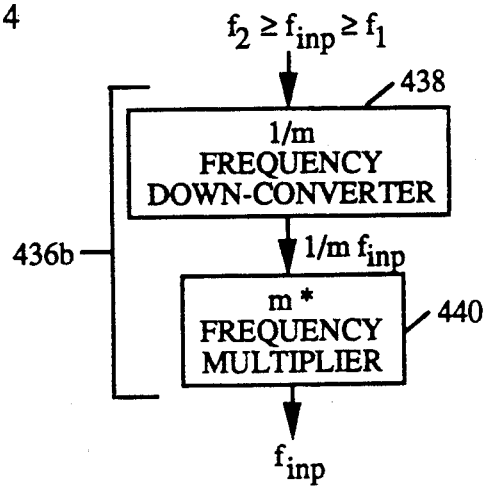

FIG. 4*b* shows a second example of the implementation of each of each of phase multipliers 436-1 and 436-2. As shown in FIG. 4*b*, each of phase multipliers 436-1 and 436-2 comprises means 436*b* that includes 1/m frequency down-converter 438, where m is a given plural integer, (which down-converter 438 includes a local oscillator having an operating frequency of either $f_{osc} = (1+m)f_{inp}$ or $f_{osc} = (1-m)f_{inp}$, a mixer for multiplying $f_{osc}$ and $f_{inp}$, and a filter for passing only the lower sideband of the mixer output) and m * frequency multiplier 440 (which may include a non-linear amplifier operating as a harmonic generator and a filter tuned to the mth harmonic of 1/m $f_{inp}$ for filtering the non-linear amplifier output). If, as shown, the input frequency to down-converter 438 is $f_2 \geqq f_{inp} \geqq f_1$, and the output from down-converter 438 and the input to frequency multiplier 440 is 1/m $f_{inp}$, the output frequency from frequency multiplier 440 will remain unchanged from the input frequency $f_{inp}$ to down-converter 438. However, because frequency conversion does not affect phase value, but frequency multiplication does, the relative difference in phase $\phi = f(\Delta t)$ between the input frequency $f_{inp}$ to the down-converter 438 of phase multiplier 436-1 and the input frequency $f_{inp}$ to the down-converter 438 of phase multiplier 436-2, the value of the relative difference in phase between the output frequency $f_{inp}$ from the frequency multiplier 440 of phase multiplier 436-1 and the output frequency $f_{inp}$ from the frequency multiplier 440 of phase multiplier 436-2 is $m\phi$. Therefore, the directional selectivity in discriminating between the correlated and uncorrelated radio-wave power of two incoming radio-wave signals arriving from only slightly different given directions of the FIG. 4 embodiment, with the FIG. 4*b* implementation of each of phase multipliers 436-1 and 436-2, is multiplied by m without any change in frequency between input and output therefrom.

Other examples of phase-multiplier implementations comprising solely a harmonic generator having a given harmonic output filter or an up and/or a down frequency converter serially connected before or after a harmonic generator having a given harmonic output filter will become apparent to those skilled in the art.

A difference-in-time-of-arrival direction finder is particularly suitable for use for locating the source of secret transmission in which the transmission frequency is continually is changed, since the correlated portion of the output power is independent of frequency. The present invention, by significantly improving the effective signal-to noise ratio of a difference-in-time-of-arrival direction finder, increases both the sensitivity and selectivity of such a direction finder so that the source of low-power secret transmissions can be more accurately located. Further, by applying such a direction-finder's output to a frequency spectrum analyzer, the continually-changing transmission frequencies of the secret transmissions may be ascertained.

In addition, the improved signal-to noise ratio of the difference-in-time-of-arrival direction finder of the present invention increases the efficiency with which each one of a relatively large group of simultaneously received radio-wave signals arriving from different directions may be sorted from one another.

Further, it has been found that difference-in-time-of-arrival techniques, in general, are particularly suitable for reducing the detrimental effects of multipath transmission of the same signal from a given transmitter to a given receiver. For instance, if a given television receiver receives a weak standard television signal, broadcast from a television station over a given frequency channel, the signal strength of the received signal can be significantly improved and multipath interference significantly decreased by using two antennas spaced apart about a meter to receive the television signal and then compensating for the time delay between the receipt of the television signal by each of the two antennas employing difference-in-time-of-arrival of techniques. This compensation for the time delay makes the two antennas effectively operate in a highly directional manner that results in the receiver not being responsive to much of the multipath interference, so that the combined effective signal strength seen by a receiver employing two antennas is improved substantially more than the expected improvement of 3 db over the signal strength of a receiver employing a single antenna. The use of the present invention enhances this improvement.

For simplicity purposes in describing the present invention, it has been assumed that the difference-in-time-of-arrival system comprises only a single pair of spaced antennas. However, it should be understood that the system may comprise a spaced distribution of three or more antennas that permits direction finding to be achieved in all three dimensions of space (i.e., in both elevation and azimuth). In this case, each separate pair of the three or more antennas is successively employed in the operation of the system, or, alternatively, an individual one of three separate systems could be employed for each of the respective separate pairs.

Further, it is known that each spot of a material object radiates an amount of microwave noise power indicative of the temperature of that spot, and that a microwave radiometer may be employed to measure this temperature. It is further known that the temperature of certain types of diseased tissue (e.g., cancer tissue) is measurably higher than surrounding normal tissue. This permits a difference-in-time-of-arrival system (e.g., a difference-in-time-of-arrival system of the type disclosed herein) employing three or more antennas surrounding tissue (e.g., breast tissue) and a radiometer operating as a microwave noise power measuring device to perform as a diagnostic tool that locates by triangulation the position of a "hot spot" in the surrounded tissue that is indicative of diseased tissue (e.g., breast cancer).

What is claimed is:

1. In a system responsive to the difference-in-time-of-arrival of received radio-wave signals; wherein said system comprises at least first and second antennas spaced apart by a predetermined distance for receiving radio-wave signals within a given frequency band, variable time delay means for relatively time delaying the radio-wave signals received by one of said first and second antennas with respect to the radio-wave signals received by the other of said first and second antennas by an amount determined by said time delay means, and auto-correlation means responsive to the correlation between the delayed radio-wave signals received by said one of said first and second antennas and the radio-wave signals received by said other of said first and second antennas; the improvement wherein said auto-correlation means comprises:

first means responsive to the relative phases of the relatively delayed radio-wave signals received by said one of said first and second antennas and the radio-wave signals received by said other of said first and second antennas for deriving a given output therefrom in which solely in-phase relatively delayed radio-wave signals received respectively by said first and second antennas are substantially cancelled and out-of-phase relatively delayed radio-wave signals received respectively by said first and second antennas are substantially passed; and second means including variable gain and delay means and responsive to said output of said first means applied thereto for reducing the relative power of said out-of-phase relatively delayed radio-wave signals with respect to that of said in-phase relatively delayed radio-wave signals in an output of said auto-correlation means.

2. The system defined in claim 1, wherein:

said first means comprises an input stage having first and second inputs and first and second outputs, first coupling means for applying the delayed radio-wave signals received by said one of said first and second antennas as said first input to said input stage and for applying the radio-wave signals received by said other of said first and second antennas as said second input to said input stage;

said input stage including first hybrid means comprising a first input port for receiving said first input to said input stage, a second input port for receiving said second input to said input stage, a difference output port for deriving an output as said given output of said first means that corresponds to the difference between the respective inputs to its first and second input ports and constitutes said first output of said input stage, and a sum output port for deriving an output that corresponds to the sum of the respective inputs to its first and second input ports and constitutes said second output from said input stage;

said second means comprises at least one feedback stage having first and second inputs and an output, and second coupling means for applying the first output of said input stage to the first input of each feedback stage and for applying the second output of said input stage to the second input of each feedback stage;

each feedback stage including second hybrid means comprising a first input port for receiving an input thereto, a second input port for receiving an input thereto, a difference output port for deriving an output corresponding to the difference between the respective inputs to its first and second input ports as said output from that feedback stage, and a sum output port for deriving an output corresponding to the sum of the respective inputs to its first and second input ports; first forwarding means including said variable gain and delay means for forwarding the first input to that feedback stage as said input to said first input port of said second hybrid means of that feedback stage; second forwarding means for forwarding the second input to that feedback stage as said input to said second input port of said second hybrid means of that feedback stage; a load resistance for dissipating the radio-wave power appearing at the sum output port of said second hybrid means of that feedback stage; and feedback means including a feedback controller responsive to the value of the radio-wave power appearing at said difference output port of said second hybrid means of that feedback stage for adjusting the gain value and the delay value provided by said variable gain and delay means to a combination of gain and delay values at which the value of the radio-wave power appearing at said difference output port of said second hybrid means of that feedback stage is reduced compared to that provided by substantially zero gain and zero delay values, whereby said reduced value of radio-wave power constitutes the output power from that feedback stage.

3. The system defined in claim 2, wherein:

said feedback controller comprises means for successively adjusting, in turn, the gain value and the delay value provided by said variable gain and delay means to each of a given two-dimensional matrix of different combinations of gain and delay values to determine which one of the different combinations of gain and delay values of said given two-dimensional matrix results in the value of the radio-wave power appearing at said difference output port of said second hybrid means of that feedback stage having a minimum value, and then setting said gain value and the delay value adjustment to that one of the different combinations of gain and delay values of said given two-dimensional matrix which resulted in the value of the radio-wave power appearing at said difference output port of said second hybrid means of that feedback stage having said minimum value.

4. The system defined in claim 2, wherein said auto-correlation means comprises a plurality of said feedback stages equal in number to N; and wherein:

said second coupling means includes corresponding first and second sets of N bandpass filters for dividing said given frequency band into N substantially similar contiguous narrower frequency bands, with the first and second outputs of said input stage being respectively applied to the first and second inputs of each separate one of said plurality of said N feedback stages through a separate corresponding pair of said N bandpass filters of said first and second sets associated with that one of said plurality of said N feedback stages, the two respective filters of a corresponding pair of said N bandpass filters passing substantially the same narrow frequency band; and said auto-correlation means further comprises signal-combining means for combining the respective outputs of said plurality of N feedback stages.

5. The system defined in claim 4, wherein:

each of said corresponding first and second sets of N bandpass filters divides said given frequency band into N substantially contiguous narrower frequency bands that are all substantially equal in bandwidth to one another.

6. The system defined in claim 4, wherein:

said feedback controller of each of said plurality of N feedback stages comprises means for successively adjusting, in turn, the gain value and the delay value provided by said variable gain and delay means to each of a given two-dimensional matrix of different combinations of gain and delay values to determine which one of the different combinations of gain and delay values of said given two-dimensional matrix results in the value of the radio-wave power appearing at said difference output port of said second hybrid means of that feedback stage having a minimum value, and then setting said gain value and the delay value adjustment to that one of the different combinations of gain and delay values of said given two-dimensional matrix which resulted in the value of the radio-wave power appearing at said difference output port of said second hybrid means of that feedback stage having said minimum value.

7. The system defined in claim 6, wherein:

each of said corresponding first and second sets of N bandpass filters divides said given frequency band into N substantially contiguous narrower frequency bands that are all substantially equal in bandwidth to one another.

8. The system defined in claim 1, wherein:

said first means comprises third means for deriving an output corresponding to the difference between a given portion of the total power of said relatively delayed radio-wave signals received by said one of said first and second antennas and substantially the same given portion of the total power of said relatively delayed radio-wave signals received by said other of said first and second antennas, whereby said in-phase relatively delayed radio-wave signals are substantially cancelled in the output of said third means and substantially the total power of the output of said third means comprises solely said out-of-phase relatively delayed radio-wave signal power; and said second means comprises (1) fourth means including a power splitter and matched variable gain means responsive to the output of said third means for deriving therefrom substantially equal power radio-wave signals as first and second outputs, (2) fifth means including time and phase trim means for separately combining said first output of said fourth means with said relatively delayed radio-wave signals received by said one of said first and second antennas and said second output of said fourth means with said relatively delayed radio-wave signals received by said other of said first and second antennas, thereby providing separate first and second combined outputs from said fifth means;

whereby the relative power of said out-of-phase relatively delayed radio-wave signals with respect to that of said in-phase relatively delayed radio-wave signals in an output of said auto-correlation means may be reduced by adjusting both said variable gain means and said time and phase trim means to achieve minimum total power in said output of said auto-correlation means.

9. The system defined in claim 8, wherein said third means comprises:

a wideband Wilkenson power combiner having first and second inputs and an output;

coupling means for coupling with opposite phases the total power of said relatively delayed radio-wave signals received respectively by said one of said first and second antennas to said first input and by said other of said first and second antennas to said second input of said wideband Wilkenson power combiner, whereby said output of said wideband Wilkenson power combiner constitutes said output of said third means.

10. The system defined in claim 9, wherein said fourth means comprises:

a wideband Wilkenson power splitter having first and second outputs and an input responsive to the output of said wideband Wilkenson power combiner; and said matched variable gain means includes a first variable-gain amplifier couped to said first output of said wideband Wilkenson power splitter and a second variable-gain amplifier couped to said second output of said wideband Wilkenson power splitter.

11. The system defined in claim 10, wherein said fifth means comprises:

matched first and second time delay means for inserting substantially the same additional delay to the relatively delayed radio-wave signals received respectively by each of said first and second antennas;

first time and phase trim means for combining said first output of said wideband Wilkenson power splitter with said additionally delayed radio-wave signal of said first of said matched first and second time delay means, and second time and phase trim means for combining said second output of said wideband Wilkenson power splitter with said additionally delayed radio-wave signal of said second of said matched first and second time delay means.

12. The system defined in claim 8, further comprising:

sixth means for deriving an output corresponding to the difference between a given portion of the total power of said first combined output of said fifth means and substantially the same given portion of the total power of said second combined output of said fifth means, whereby in-phase radio-wave signal components of said first combined output and said second combined output of said fifth means are substantially cancelled in the output of said sixth means and substantially the total power of the output of said sixth means comprises solely out-of-phase radio-wave signal component power; and seventh means comprising (1) eighth means including a power splitter and matched variable gain means responsive to the output of said sixth means for deriving therefrom substantially equal power radio-wave signals as first and second outputs, (2) ninth means including time and phase trim means for separately combining said first output of said eighth means with said first combined output of said fifth means and said second output of said eighth means with said second combined output of said fifth means;

whereby the relative power of said out-of-phase relatively delayed radio-wave signals with respect to that of said in-phase relatively delayed radio-wave signals in an output of said auto-correlation means may be reduced by first adjusting both said variable gain means and said time and phase trim means of said fifth means to achieve a first minimum total power in said output of said auto-correlation means, and then adjusting both said variable gain means and said time and phase trim means of said ninth means to achieve a second minimum total power in said output of said auto-correlation means which is lower than said first minimum total power.

13. The system defined in claim 1, wherein the phase difference between said radio-wave signals received by said first and second antennas have certain values, and wherein said system further comprises:

respective phase-multiplier means coupled to each of said first and second antennas for deriving values of the phase difference between said radio-wave signals at inputs to said auto-correlation means which are increased with respect to said certain values thereof.

14. The system defined in claim 13, wherein:

each phase-multiplier means consists solely of means for deriving a given harmonic of frequencies within said given frequency band.

15. The system defined in claim 13, wherein:

each phase-multiplier means comprises serially-connected (1) converter means for down-shifting the input frequencies thereto by that amount which derives output frequencies therefrom that are 1/m of the input frequencies, and (2) harmonic generator means for multiplying the input frequencies thereto by that amount which derives output frequencies therefrom that are m times the input frequencies, where m is a plural integer.

16. In a system responsive to the difference-in-time-of-arrival of received radio-wave signals; wherein said system comprises first and second antennas spaced apart by a predetermined distance for receiving radio-wave signals within a given frequency band, variable time delay means for time delaying the radio-wave signals received by one of said first and second antennas with respect to the radio-wave signals received by the other of said first and second antennas by an amount determined by said time delay means, and auto-correlation means responsive to the correlation between the delayed radio-wave signals received by said one of said first and second antennas and the radio-wave signals received by said other of said first and second antennas; the improvement wherein said given frequency band is a relatively-low frequency band and the phase difference between said radio-wave signals received by said first and second antennas have certain values, and wherein said system further comprises:

first phase-multiplier means inserted only between said one of said first and second antennas and a first input of said auto-correlation means and second phase-multiplier means inserted only between said other of said first and second antennas and a second input of said auto-correlation means for deriving values of the phase difference between said radio-wave signals at said first and second inputs to said auto-correlation means which are increased with respect to said certain values thereof.

17. The system defined in claim 16, wherein:

each phase-multiplier means consists solely of means for deriving a given harmonic of frequencies within said given frequency band.

18. The system defined in claim 16, wherein:

each phase-multiplier means comprises serially-connected (1) converter means for down-shifting the input frequencies thereto by that amount which derives output frequencies therefrom that are 1/m of the input frequencies, and (2) harmonic generator means for multiplying the input frequencies thereto by that amount which derives output frequencies therefrom that are m times the input frequencies, where m is a plural integer.

19. In a system responsive to the difference-in-time-of-arrival of received radio-wave signals; wherein said system comprises first and second antennas spaced apart by a predetermined distance for receiving radio-wave signals within a given frequency band, variable time delay means for time delaying the radio-wave signals received by one of said first and second antennas with respect to the radio-wave signals received by the other of said first and second antennas by a selected amount determined by the setting of said variable time delay means, and auto-correlation means responsive to the delayed radio-wave signals received by said one of said first and second antennas applied as a first input thereto and the radio-wave signals received by said other of said first and second antennas applied as a second input thereto for deriving a radio-wave output therefrom; and wherein said radio-wave first and second inputs to said auto-correlation means includes a correlated component having a value corresponding to the radio-wave power of a given received signal having a difference-in-time-of-arrival at said first and second antennas substantially equal to said selected amount of time delay and an uncorrelated component having a value corresponding to the radio-wave power of all received signals having a difference-in-time-of-arrival at said first and second antennas substantially unequal to said selected amount of time delay; the improvement wherein said auto-correlation means comprises:

means including power dissipating means for dissipating more of the radio-wave power of said uncorrelated component than of the radio-wave power of said correlated component;

whereby the ratio of said correlated component to said uncorrelated component in the output of said auto-correlation means is increased with respect to the ratio of said correlated component to said uncorrelated component in the first and second inputs to said auto-correlation means.

* * * * *